US005509145A

United States Patent [19]

Stevenson et al.

[11] Patent Number: 5,509,145

[45] Date of Patent: Apr. 23, 1996

[54] CAP WITH OPENING HAVING A REMOVABLE CLOSURE

[76] Inventors: Karen L. Stevenson, 724 Mckinstry Ave., Chicopee, Mass. 01020; Debra M. Laramee, 11 Columbus Ave.; Cynthia L. Demers, 39 O'Connor Ave., both of Holyoke, Mass. 01040

[21] Appl. No.: 323,689

[22] Filed: Oct. 18, 1994

[51] Int. Cl.[6] ..... A42B 1/04

[52] U.S. Cl. ..... 2/195.1; 2/171.1; 2/171.4; 2/181.4; 2/184.5; 2/209.13; 2/209.7

[58] Field of Search ..... 2/171, 171.1, 171.4, 2/171.5, 171.6, 171.7, 171.8, 175.1, 181, 181.2, 181.4, 184.5, 195.1, 209.11, 209.12, 209.13, 209.3, 209.7

[56] References Cited

U.S. PATENT DOCUMENTS

D. 173,620 12/1954 Krieger .
2,112,383 3/1938 Sloan et al. ..... 2/184.5
2,147,873 2/1939 Wittcoff .
4,131,953 1/1979 Kimotsuki ..... 2/171.1
4,872,218 10/1989 Holt ..... 2/171.5
5,170,509 12/1992 Leopold .
5,239,705 8/1993 Leopold .
5,321,854 6/1994 Kronenberger .

FOREIGN PATENT DOCUMENTS 506725 10/1954 Canada .
825461 12/1951 Germany ..... 2/209.13

*Primary Examiner*—Diana Biefeld
*Attorney, Agent, or Firm*—Richard C. Litman

[57] ABSTRACT

A headwear item, more particularly a baseball-style cap, having a hole at the top of the crown for a ponytail or braid to pass through and a removable closure that conceals the hole at the option of the wearer. The cap also has a pocket sewn on the inside of the crown to allow the stowage of the removable closure when it is not in use. This arrangement allows the cap to be worn by men and women with short hair as well as by those who wear their hair in a ponytail or braid.

14 Claims, 5 Drawing Sheets

CAP WITH OPENING HAVING A REMOVABLE CLOSURE

BACKGROUND OF THE INVENTION

1. Field of the Invention

The present invention relates to a headwear item, more particularly, to a baseball-style cap having an opening at the topmost portion of the crown to allow hair gathered in a ponytail or braid to pass therethrough, and a closure for the opening in order to conceal the opening when the cap is worm by a wearer with short hair.

2. Description of the Prior Art

Baseball style caps are commonly worn by people involved in sports activities and as fashion accessories. People with long hair find the traditional baseball cap uncomfortable to wear because their hair tends to get bunched up under the cap. In addition, it has now become fashionable to allow hair gathered into a ponytail or braid to hang out of the size adjustment cutout commonly found on the back of most baseball caps.

This solution however has been less than satisfactory because the adjustment cutout is generally lower than the base of the ponytail or braid so that a portion of the ponytail or braid still has to extend between the crown of the cap and the wearer's head. Therefore the problems associated with baseball caps not having the adjustment cutout still persist.

For the above reasons, many headwear items have been proposed that have openings provided specifically for a ponytail or braid to pass through.

U.S. Pat. No. 5,321,854, issued to Kronenberger, and U.S. design Pat. No. 173,620, issued to Krieger et al., show headwear items that have openings provided specifically for a ponytail or braid to pass through. The Kronenberger and Krieger et al. patents do not teach or suggest providing a removable closure for concealing the opening for the ponytail or braid. Thus the Kronenberger and Krieger et al. headwear are not suitable for men or women with short hair.

U.S. Pat. No. 5,239,705 and U.S. Pat. No. 5,170,509, both issued to Leopold, show ponytails passing through the adjustment cutout at the back of the baseball cap. The Leopold patents do not teach or suggest providing a separate opening for the ponytail, or providing a removable closure for concealing such an opening in a baseball cap.

U.S. Pat. No. 2,147,873, issued to Wittcoff, shows a closure for a headwear item made of two metal disks welded together. Wittcoff does not teach or suggest the use of a removable closure of the type used in the present invention.

Canadian patent 506 725 issued to Hoeflich, discloses a paper baseball cap, but does not teach or suggest the use of a removable closure of the type used in the present invention.

None of the above inventions and patents, taken either singly or in combination, is seen to describe the instant invention as claimed.

SUMMARY OF THE INVENTION

The present invention is a headwear item having a hole at the top of the crown for a ponytail or braid to pass through and a removable closure that can conceal the hole at the option of the wearer. The headwear item of the present invention has a pocket provided on the interior thereof for stowing the removable closure when the closure is not in use. The headwear item of the present invention can be worn by men or women with short hair with the closure in place over the hole, or by women who wear their hair in a ponytail or braid with the closure removed to allow the wearer's hair to pass through the hole.

Accordingly, it is a principal object of the invention to provide a headwear item having an opening for a ponytail or braid to pass therethrough and allow the opening to be concealed at the option of the wearer.

It is another object of the invention to provide a headwear item with a removable closure which can be easily applied and removed for concealing and revealing, respectively, an opening for a ponytail or braid.

It is a further object of the invention to provide a headwear item that can maintain the wearer's hair in a ponytail configuration without any need for other accessories.

Still another object of the invention is to provide a headwear item that has provision for stowing the removable closure when it is not in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
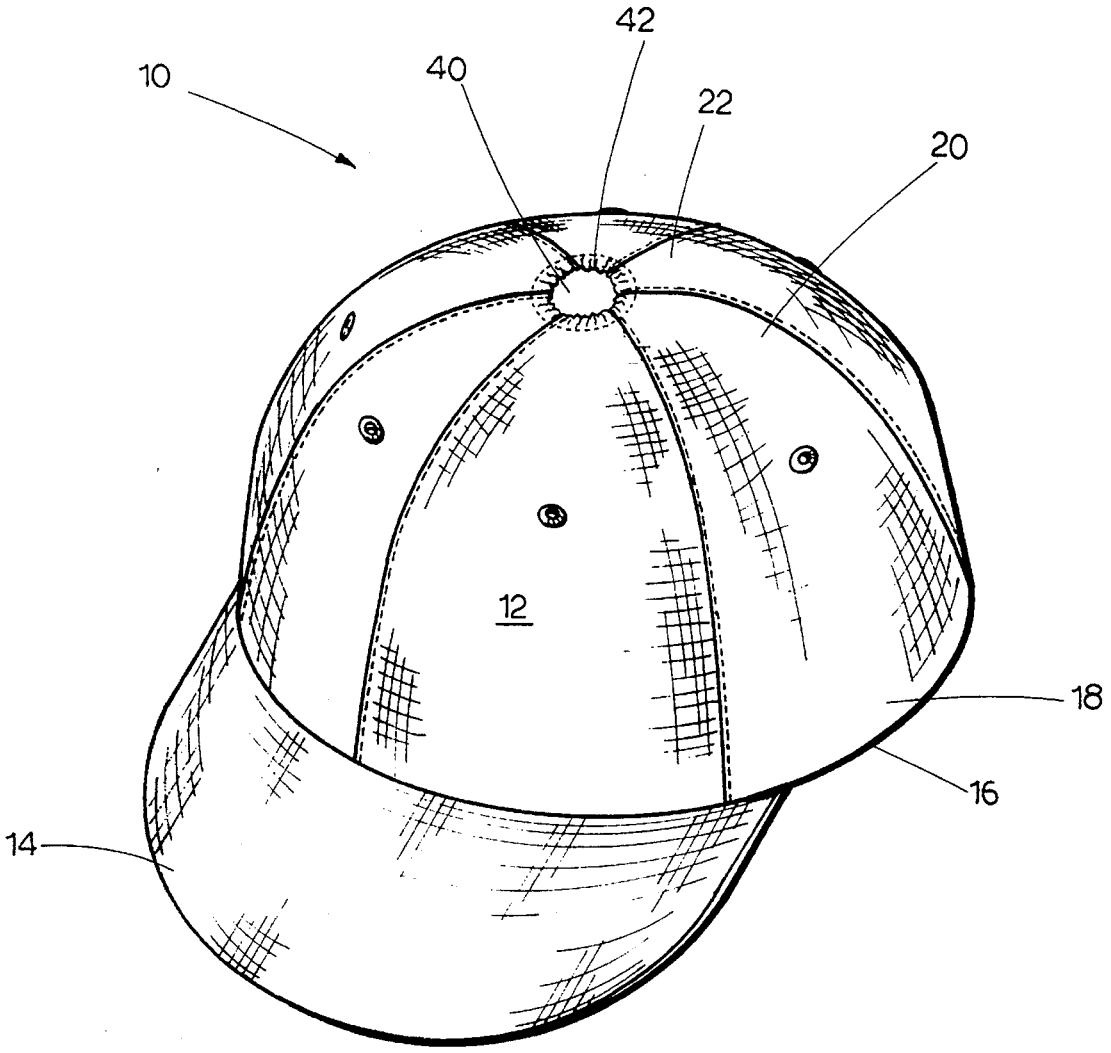
FIG. 1 is a perspective view of the headwear item of the present invention with the closure removed from the crown opening.
Figure 2:
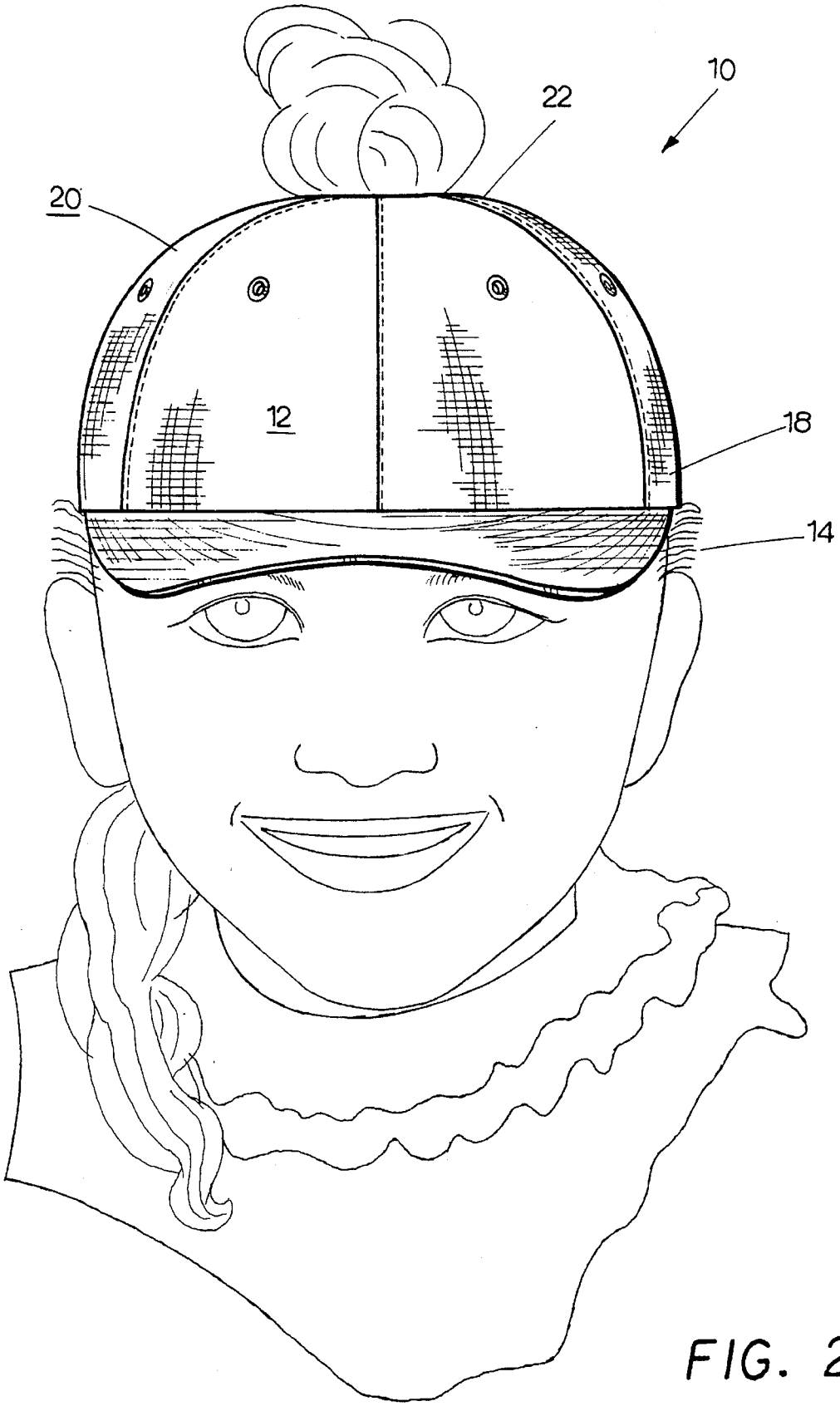
FIG. 2 is an environmental, front elevational view of the headwear item of the present invention showing a ponytail passed through the crown opening.
Figure 3:
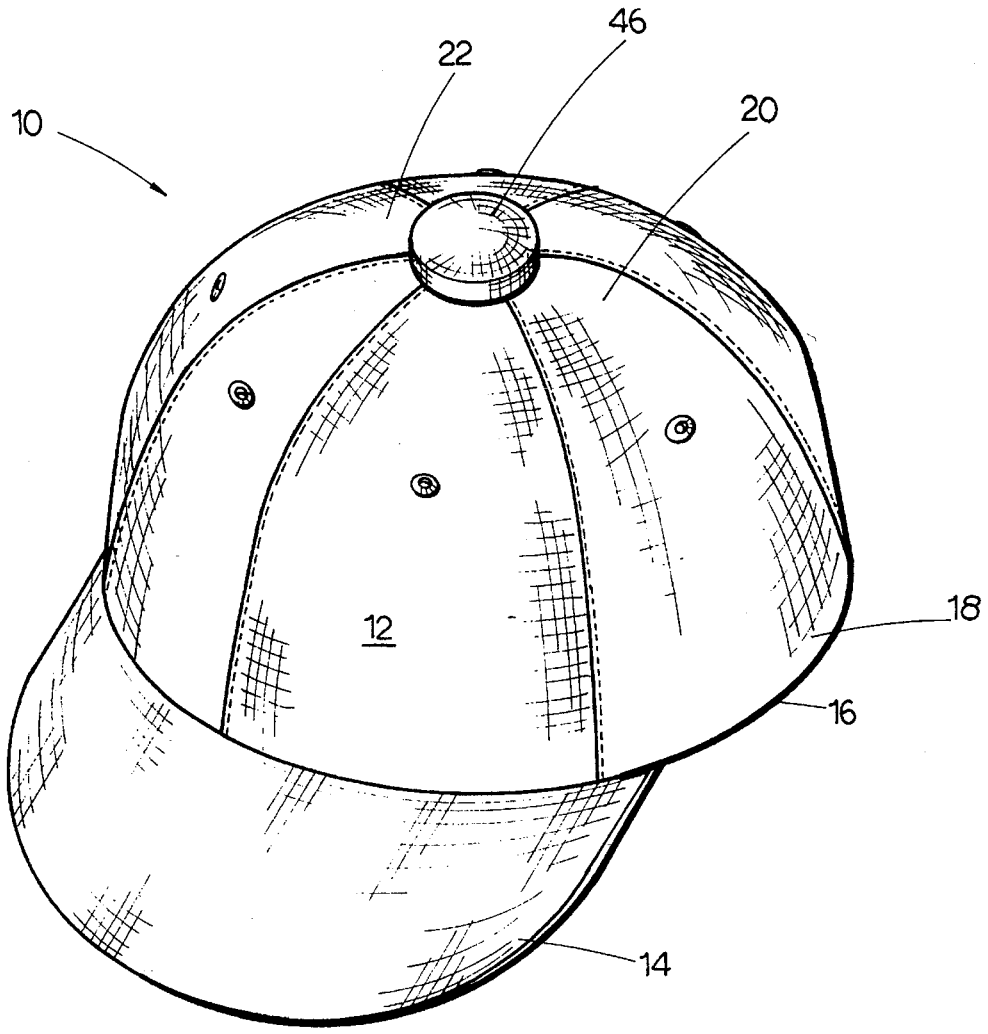
FIG. 3 is a perspective view of the headwear item of the present invention with the closure in place at the crown opening.

Referring to FIGS. 1, 2 and 3, the present invention is a headwear item 10 of the type commonly referred to as a baseball style cap. The headwear item 10 includes a cap portion 12 and a visor 14.

The cap portion 12 is preferably made of panels of cloth, fiber mesh, or the like, sewn together at the edges so as to define a cavity dimensioned and configured to accommodate a wearer's head. The cap portion 12 includes a rim 16 defining the opening to the cavity formed by the cap portion 12, to allow the cap portion 12 to receive the wearer's head. The visor 14 which is generally crescent shaped, is attached to the cap portion 12 along a portion of the rim 16. The visor 14 is relatively rigid and the headwear item 10 is preferably worn in such a manner as to position the visor 14 above the wearer's eyes in order to shield the wearer's eyes from the sun and the elements.

The cap portion 12 further includes a headband portion 18 and a crown portion 20. The headband portion 18 is a generally cylindrical portion of the cap portion 12, extending between the rim 16 and the crown portion 20, which snugly fits about the wearer's head when the headwear item 10 is properly adjusted to fit a particular wearer. The crown portion 20 is the dome shaped upper portion of the cap portion 12, extending above the headband portion 18. The top most part of the crown portion 20 forms the apex portion 22.

Figure 6:
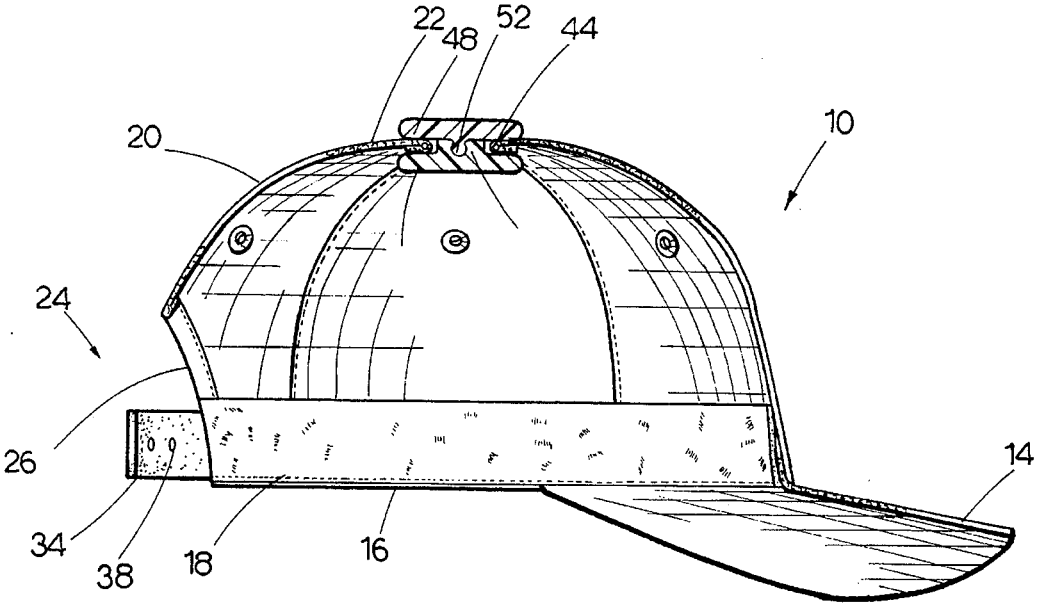
FIG. 6 is a cross-sectional view of the headwear item of the present invention showing the details of the removable closure.
Figure 4:
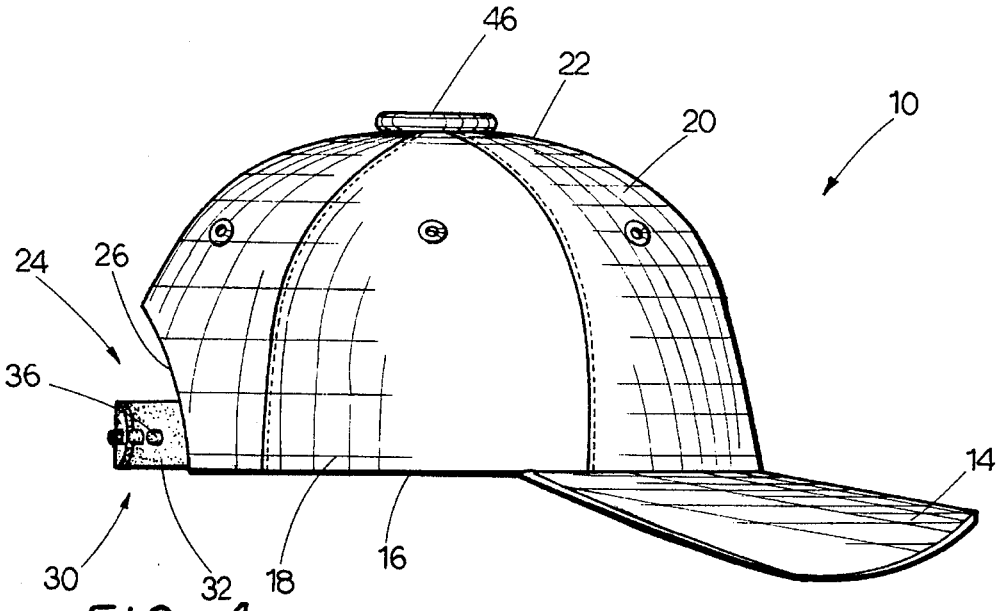
FIG. 4 is a side elevational view of the present invention with the closure in place at the crown opening.
Figure 5:
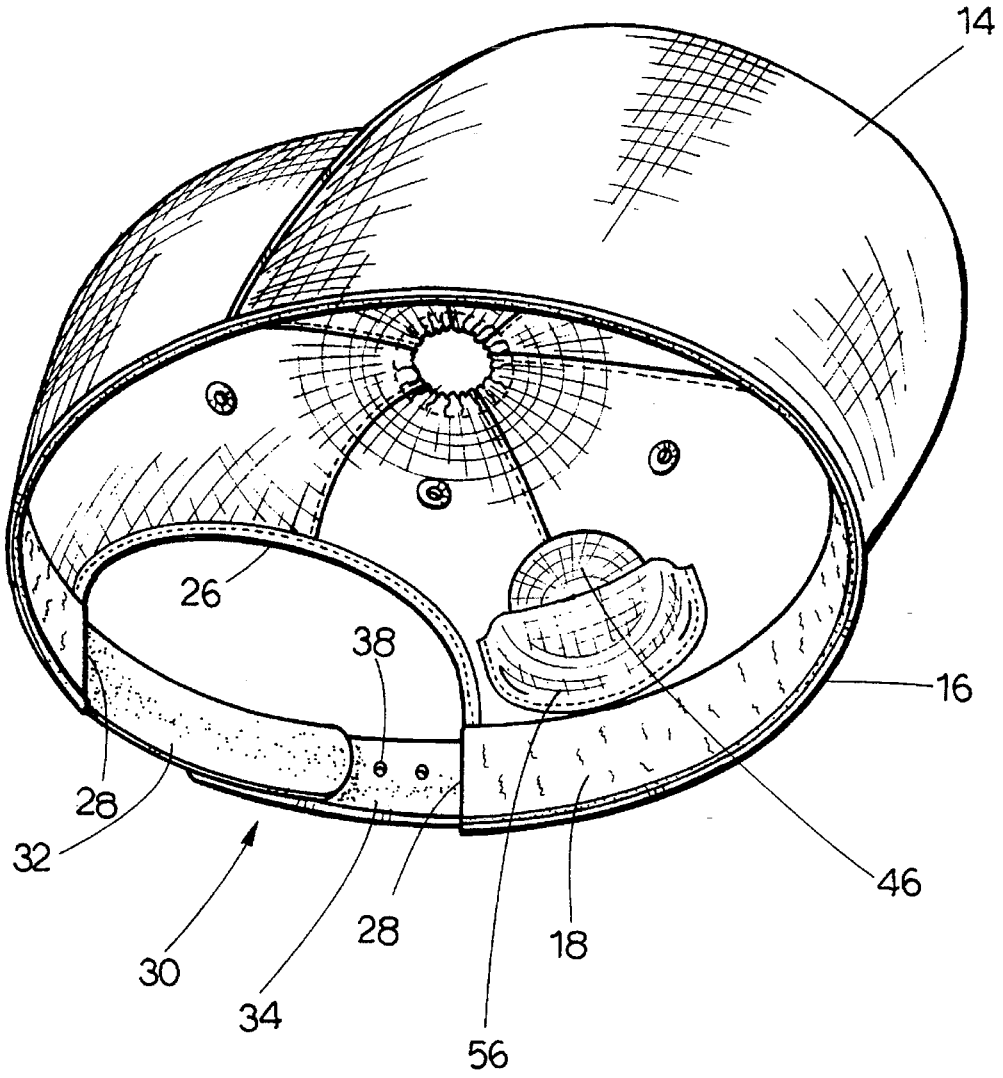
FIG. 5 is a bottom perspective view of the headwear item of the present invention showing the pocket for stowing the closure for the crown opening.

Referring to FIGS. 4, 5, and 6, the cap portion 12 is provided with an adjustment portion 24 to allow the perimeter of the rim 16 to be selectively varied to fit any particular wearer. The adjustment portion 24 includes an inverted U-shaped cutout 26 provided in the side of the cap portion 12 opposite the rim portion where the visor 14 is attached. The inverted U-shaped cutout 26 has lateral edges 28 which intersect the rim 16. At the bottom of the lateral edges 28 is an adjustable strap 30, the length of which can be altered to vary the spacing between the lateral edges 28, thereby selectively increasing or decreasing the perimeter of the rim 16. The strap 30 is comprised of first and second strap portions 32 and 34 respectively. The strap portion 32 is provided with projections 36 which engage holes 38 in strap portion 34 in order to maintain the strap 30 at the desired length. The length of the strap 30 can be varied by varying the amount of overlap between the strap portions 32 and 34 thus varying the number of projections 36 that are in registry with holes 38. The strap portions 32 and 34 are then pressed together to engage the projections 36, that are in registry with holes 38, with the corresponding holes 38 in order to maintain the strap 30 at the desired length.

A second opening 40 is provided proximate the apex portion 22. The second opening 40 is provided to allow wearers with long hair who have gathered their hair into a ponytail or a braid to pass the ponytail or braid therethrough, thus preventing their hair from being bunched up under the cap portion 12. The opening 40 is preferably substantially concentric with the opening defined by the rim 16.

The opening 40 is provided with an elastic gather 42 in order to maintain the wearer's hair in the ponytail configuration without any need for separate devices for maintaining the hair in the ponytail configuration. However other accessories such as decorative elastic hair bands, Commonly called "scrunchies" can be worn around the base of the pony tail, just outside the opening 40, for aesthetic reasons. The elastic gather 42 is formed simply by sewing an elastic band 44 into the rim of the opening 40. The elastic gather 42 also functions to make the opening 40 smaller when the elastic gather is in the relaxed position, thus allowing the opening 40 to be concealed more easily as discussed below.

When the headwear item 10 is worn by a male or a female with short hair the opening 40 will no longer be used and, especially in the case of a male wearer, it may be desirable to conceal the opening 40. To this end a closure 46 is provided for the opening 40.

The closure includes an outer member 48 and an inner member 50. The outer member 48 is in the shape of a decorative button large enough to conceal the opening 40, and the outer member carries a male fastener portion 52. The inner member 50 is in the shape of a disk and carries a female fastener portion 54. In use the male fastener portion 52 passes through the opening 40 and engages the female fastener portion 54, thus sandwiching the gather 42 between the outer member 48 and the inner member 50. In this manner the closure 46 is maintained in place to conceal the opening 40.

When not in use, the closure 46 can be stowed in pocket 56 sewn to the inner surface of the crown portion 20. The pocket 56 is preferably provided above the headband portion 18 so as to prevent any discomfort to the wearer that may be caused by the closure 46 being pinched between the headband portion 18 and the wearer's scalp. Most preferably the pocket 56 is sewn to the inner surface of the crown portion 20 so that it is above the head band portion 18 and just to either side of the cutout 26.

It is to be understood that the present invention is not limited to the sole embodiment described above, but encompasses any and all embodiments within the scope of the following claims.

We claim:

1. A headwear item comprising:

a cap portion having a rim and a crown portion, said crown portion having an apex portion, said cap portion defining a cavity dimensioned and configured to accommodate a wearer's head, and said rim defining an opening to said cavity to allow said cavity to receive the wearer's head;

a visor attached to said cap portion along a portion of said rim;

a second opening provided proximate said apex portion of said crown portion;

an elastic gather provided about the perimeter of said second opening; and a closure removably engaging said second opening.

2. The headwear item according to claim 1, wherein said closure comprises:

an outer member substantially covering said second opening; and an inner member engaging said outer member so as to retain said outer member in place.

3. A headwear item according to claim 1, wherein said cap portion includes an adjustment portion for varying the perimeter of said opening defined by said rim.

4. A headwear item according to claim 1, further including:

a pocket provided on the interior surface of said cavity to stow said closure when said closure is removed from said second opening.

5. A headwear item according to claim 4, Wherein said cap portion further includes a headband portion and said pocket is disposed above said headband portion.

6. A headwear item according to claim 2, wherein said cap portion includes an adjustment portion for varying the perimeter of said opening defined by said rim.

7. A headwear item according to claim 2, further including:

a pocket provided on the interior surface of said cavity to stow said closure when said closure is removed from said second opening.

8. A headwear item according to claim 7, wherein said cap portion further includes a headband portion and said pocket is disposed above said headband portion.

9. A headwear item according to claim 2, wherein said outer member is a decorative button carrying one of a male and a female fastener portion, and said inner member is a disk carrying the other of a male and a female fastener portion.

10. A headwear item according to claim 9, wherein said cap portion includes an adjustment portion for varying the perimeter of said opening defined by said rim.

11. A headwear item according to claim 9, further including:

a pocket provided on the interior surface of said cavity to stow said closure when said closure is removed from said second opening.

12. A headwear item according to claim 11, wherein said cap portion further includes a headband portion and said pocket is disposed above said headband portion.

13. A headwear item comprising:

a cap portion having a rim and a crown portion, said crown portion having an apex portion, said cap portion defining a cavity dimensioned and configured to accommodate a wearer's head, and said rim defining an opening to said cavity to allow said cavity to receive the wearer's head;

a visor attached to said Cap portion along a portion of said rim;

a second opening provided in said crown portion;

an elastic gather provided about the perimeter of said second opening; and a closure removably engaging said second opening.

14. The headwear item according to claim 13, wherein said closure comprises:

an outer member substantially covering said second opening, said outer member being a decorative button carrying one of a male and a female fastener portion; and an inner member engaging said outer member so as to retain said outer member in place, said inner member being in the shape of a disk and carrying the other of a male and a female fastener portion.

* * * * *